United States Patent [19]

Ardis

[11] 3,949,439

[45] Apr. 13, 1976

[54] FIREMAN'S COMPOSITE TOOL

[76] Inventor: Alfred J. Ardis, Cantiague Lane, Westbury, N.Y. 11590

[22] Filed: June 18, 1975

[21] Appl. No.: 587,853

[52] U.S. Cl. ..... 7/1 G; 7/14.3
[51] Int. Cl.[2] ..... B25F 1/04
[58] Field of Search ..... 7/1 R, 1 G, 14.3; 294/26

[56] References Cited

UNITED STATES PATENTS

| | | | |
|---|---|---|---|
| 466,628 | 1/1892 | Shea | 7/14.3 |
| 539,793 | 5/1895 | Carrington | 7/1 R |
| 845,709 | 2/1907 | Gladding | 7/1 R |
| 1,784,535 | 12/1930 | Osterby | 7/1 G |

*Primary Examiner*—Al Lawrence Smith
*Assistant Examiner*—Roscoe V. Parker

[57] ABSTRACT

A combination tool especially suited for firemen, including a number of cooperating elements for efficient operation during a fire. A large hook, normally folded to protect the hook point, and a folding pull handle are the primary components. Other useful elements comprise a spanner wrench for opening and closing hose couplings, and a socket wrench for operating water and gas valves. The tool is small enough to be carried in a fireman's coat pocket.

8 Claims, 8 Drawing Figures

FIREMAN'S COMPOSITE TOOL

BACKGROUND OF THE INVENTION

Operations required of a fireman are unpredictable and many unusual conditions are encountered during a fire. One of the most difficult operations is the handling of large bulky furniture pieces such as a mattress or sofas when they are burning. The hook portion of the present invention is designed for use with such objects, to drag them from a burning building or to a place where the fire may be extinguished. Other important operations include the coupling and uncoupling of water hose lengths, the operation of water and gas supply valves, and the general handling of debris. The composite tool is designed to handle all of these requirements. An alternate form of tool is made with a shaft and handle of nonconducting plastic to guard the fireman from electrical shocks when moving about electrical equipment.

One of the features of the invention is the provision of a readily portable hook for grasping the dragging large pieces of equipment from a burning building.

Another feature of the invention is a rotatable pull handle for compact storage and quick positive manual operation.

Another feature of the invention is a pawl and recess combination for holding a folding hook in its operating position.

Additional features and details of the invention will be disclosed in the following description, taken in connection with the accompanying drawings forming part of the present disclosure.

DESCRIPTION OF THE PREFERRED EMBODIMENT

Figure 1:
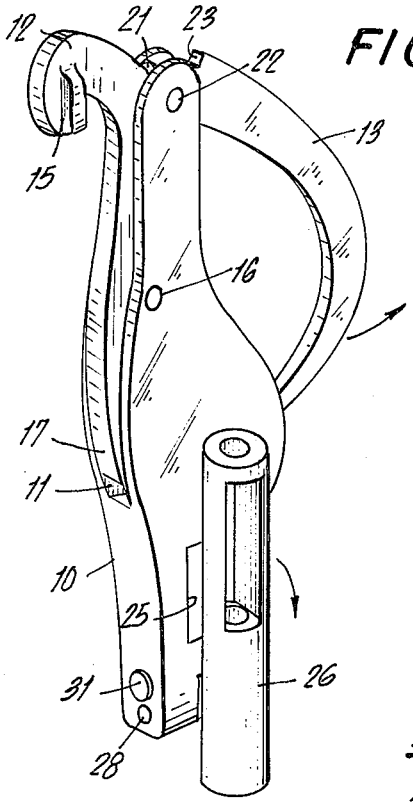
FIG. 1 is a perspective view of a composite tool in its folded condition made according to the present invention.
Figure 2:
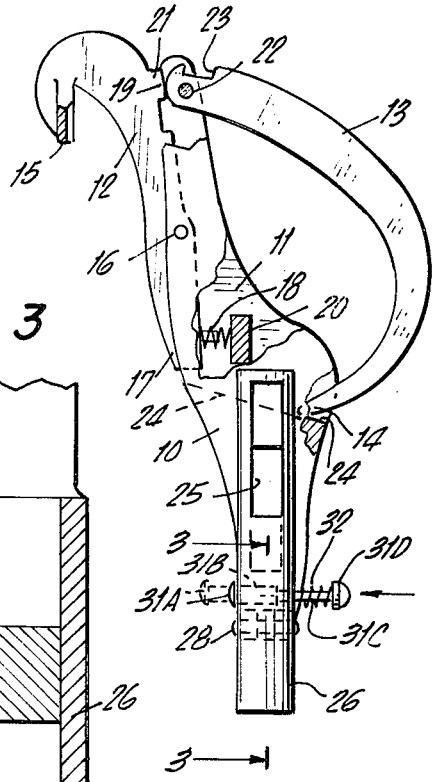
FIG. 2 is a side view of the tool partially broken away to show the internal construction.
Figure 3:
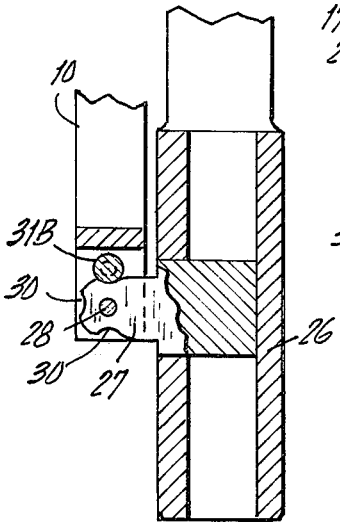
FIG. 3 is a fragmentary cross section of the handle shown in FIG. 2 on an enlarged scale and is taken along line 3—3 of that figure.

Referring to FIGS. 1 and 2, the composite tool comprises a main body portion 10, the upper end of which is formed with a deep slot 11 to receive a portion of a spanner wrench 12 and one end of a large hook 13 with a pointed end 14. The spanner wrench 12 is formed with a single tooth 15 designed to fit into a recess in a standard hose coupling. The wrench is coupled to the main body portion by a pivot pin 16 and has a lower extension 17 which bears against a helical spring 18 anchored by a lug 20 in the main body 10.

A pawl 21 is formed integral with the spanner wrench and extends into the slot 11. When the hook is in its closed position, as shown in FIGS. 1 and 2, the pawl 21 rests against a curved cam 19 of the hook 13 adjacent to a pivot pin 22. The pivot pin 22 rockably supports the hook 13 between the body portions which define the slot 11. The cam 19 is formed with a recessed portion 23 for receiving the pawl 21 when the hook 13 is swung to its operating position. In order to disengage the pawl 21 from the recessed portion, pressure is exerted on the lower end 17 of wrench 12, rocking it about pivot 16 against the force of spring 18 and withdrawing the pawl from the recess 23. The hook 13 may then be folded into its closed position with the point 14 protected by a socket formed by the slot 11.

Figure 6:
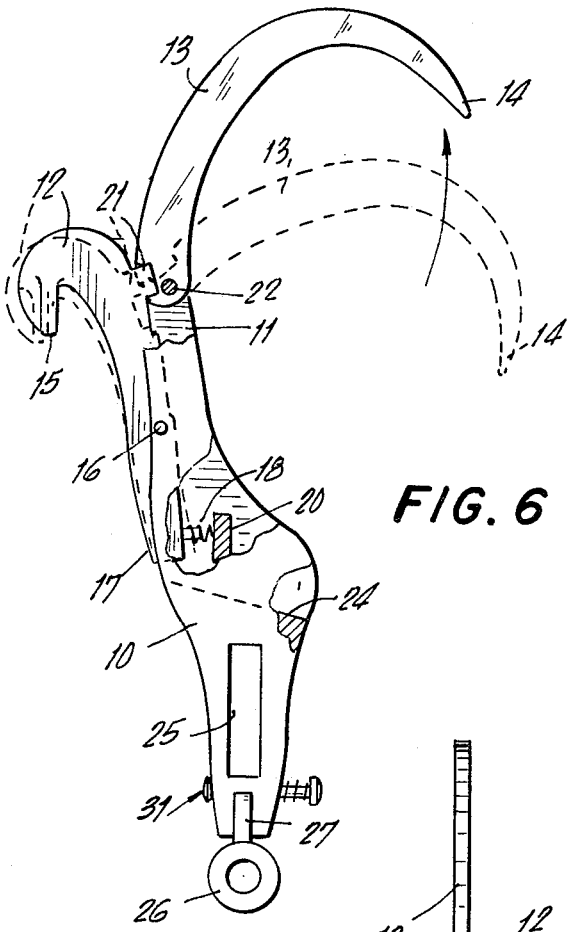
FIG. 6 is a side view of the tool, with some parts broken away, showing how the hook member is folded into its non-operating position.
Figure 7:
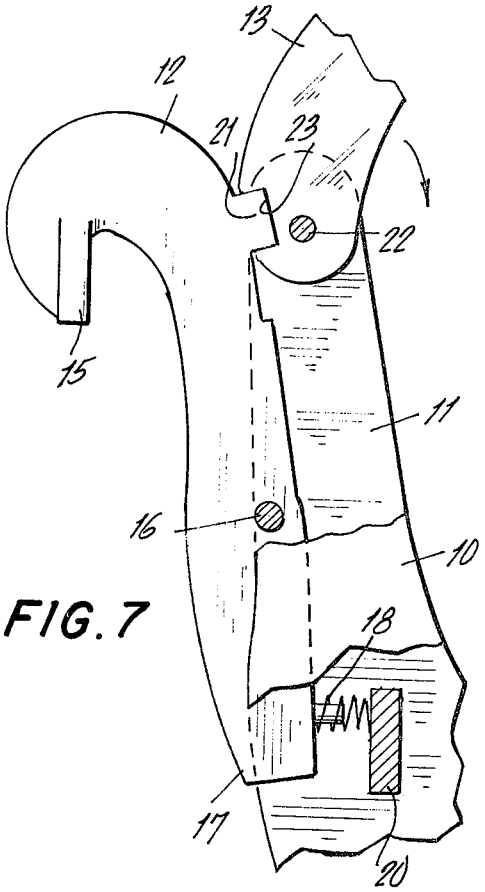
FIG. 7 is a fragmentary view of the tool, to a larger scale, illustrating the hook pawl locking means.
Figure 8:
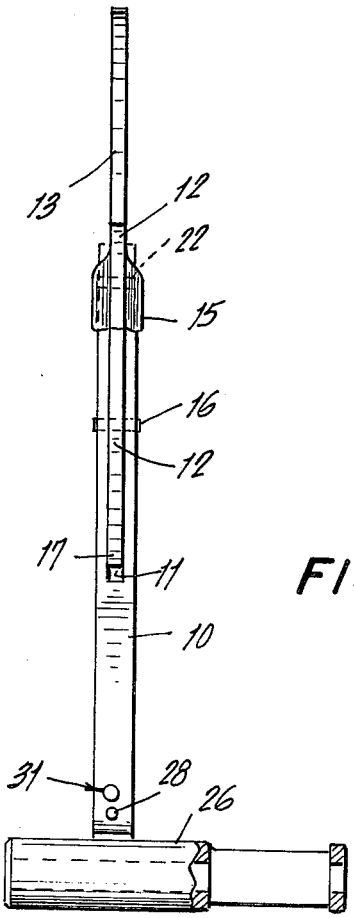
FIG. 8 is an end view of the tool with both the hook and the pull handle in their operating position.

Slot 11 extends through the body of the tool to a bottom wall indicated by dotted line 24, shown in FIGS. 2 and 6. Below that wall, the tool body 10 is solid except for a rectangular opening 25 cut through the tool body 10. The opening 25 is designed for use as a socket wrench and is made large enough to fit over several standard valve handles for the control of water or gas flow. The main body 10 may be made of steel, but in cases where electrical wiring may be exposed, the body is preferably made of an insulating material such as high density polyethylene.

Figure 4:
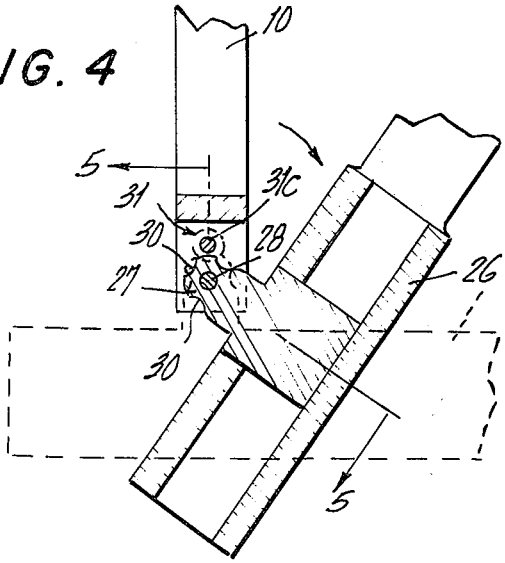
FIG. 4 is a cross sectional view similar to FIG. 3 but showing the pull handle partially rotated into its operating position.

At the lower extremity of the tool, a pull-handle 26 is pivotally mounted for movement into an operative position as illustrated by the dotted lines in FIG. 4. Handle 26 is formed with a "T" extension 27 having a bore to receive a pivot pin 28. The pivot pin 28 pivotally secures the handle extension 27 in a small slot in the base of the tool and permits the operator to fold the handle 26 to a stored position adjoining the side of the tool body 10 as shown in FIGS. 1 and 2. The extension 27 is formed with three arcuate depressions 30 which cooperate with a spring loaded slidable pin 31 to form positive detents which can anchor the pull handle in any one of three positions.

Figure 5:
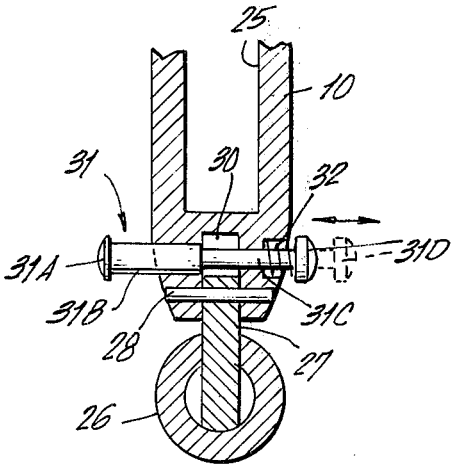
FIG. 5 is a cross sectional view of the pull handle shown in FIG. 4 and is taken generally along line 5—5 of that Figure.

Pin 31 is formed with a head 31A, an enlarged cylindrical section 31B for shifting into an unlocked position when the handle 26 is to be rotated, and a second head 31D at the other end of the pin. A helical spring 32 is mounted between the second head 31D and the main body member 10 for normally positioning the pin 31 in its locking position. When locked, the larger portion 31B of the pin engages one of the three depressions 30 and the handle is held from rotation. To move the handle to another position, the operator depresses head 31D, moving the larger portion 31B into the position shown in FIG. 5. With the smaller portion 31C of pin 31 overlying the depressions 30 in extension 27, the handle 26 may be swung around pin 28 to any desired position.

From the above description it will be evident that the composite tool includes a plurality of components which, acting together, form several useful aids for operation by a fireman during a fire call.

Having thus fully described the invention, what is claimed as new and desired to be secured by Letters Patent of the United States is:

1. A composite tool for a variety of fire fighting purposes comprising:

a. a main body having an elongated median slot at one end thereof;

b. a pull-handle rockably secured to the unslotted end of the main body for manual operation;

c. a metal hook rotably coupled at one end to the body within the slot for convenient folding to a position where the outer end of the hook lies within the slot;

d. a spanner wrench positioned in said median slot for operating pipe couplings;

e. a pawl and recess combination on the spanner wrench and hook for retaining the hook in its extended operating position, the recess formed in the hook and the pawl resiliently engaged; and f. socket wrench means in the tool body.

2. A tool according to claim 1 wherein said hook is formed with a sharp point at its outer end.

3. A tool according to claim 1 wherein the pull handle is coupled to the main body by means of a "T" extension rockably movable about a pivot pin, said extension formed with a plurality of depressions for engagement by a locking pin.

4. A tool according to claim 3 wherein the depressions in the side extensions cooperate with a spring loaded locking pin which may be disengaged from the depressions when the handle is moved to a new position.

5. A tool according to claim 1 wherein the main body wrench means is a rectangular slot for engagement with gas valve stems.

6. A tool according to claim 1 in which the spanner wrench is normally urged in the direction of the hook by a spring.

7. A tool according to claim 3 in which the pivot pin has a two diameter body portion for engagement and disengagement with the handle depressions.

8. A tool according to claim 1 in which the main body is made of a dielectric material.

* * * * *